US006620230B1

(12) United States Patent
Wiethorn et al.

(10) Patent No.: US 6,620,230 B1
(45) Date of Patent: Sep. 16, 2003

(54) MOLD RELEASE COMPOSITION

(75) Inventors: Robert Wiethorn, Cincinnati, OH (US); Lev Dashevsky, Cincinnati, OH (US); Jason Huff, Cincinnati, OH (US)

(73) Assignee: Franklynn Industries, Inc., Cincinnati, OH (US)

( * ) Notice: Subject to any disclaimer, the term of this patent is extended or adjusted under 35 U.S.C. 154(b) by 64 days.

(21) Appl. No.: 10/071,112

(22) Filed: Feb. 8, 2002

Related U.S. Application Data

(60) Provisional application No. 60/268,376, filed on Feb. 12, 2001.

(51) Int. Cl.[7] ..... B28B 7/36; B28B 7/38

(52) U.S. Cl. ..... 106/38.22; 106/38.2; 106/38.24; 106/38.7; 264/333; 264/338; 264/213

(58) Field of Search ..... 106/38.2, 38.22, 106/38.24, 38.25, 38.7, 38.8; 427/133; 264/333, 338, 213

(56) References Cited

U.S. PATENT DOCUMENTS

| | | | | |
|---|---|---|---|---|
| 4,740,324 | A | 4/1988 | Schur | 252/56 |
| 5,194,584 | A | 3/1993 | Leahy | 530/210 |
| 5,374,303 | A | 12/1994 | van Hoorn | 106/38.22 |
| 5,447,563 | A | 9/1995 | van Hoorn | 106/38.22 |
| 5,523,010 | A | 6/1996 | Sorensen et al. | 252/52 R |
| 5,709,739 | A | 1/1998 | Wittich et al. | 106/38.22 |

OTHER PUBLICATIONS

*Form Release Agent* (*Premium Grade*), AG Environmental Products Website, Downloaded Apr. 2002, Date of publication unavailible.

*Form Release Agent* (*Economy Grade*), AG Environmental Products Website, Downloaded Apr. 2002, Date of publication unavailible.

*Primary Examiner*—Michael Marcheschi
(74) *Attorney, Agent, or Firm*—Wood, Herron & Evans, LLP

(57) ABSTRACT

A mold release composition and a method of forming molded articles using the mold release composition. The mold release composition of the present invention comprises at least one low vapor pressure hydrocarbon fluid and may further include an acid bearing release modifying material. An effective amount of the mold release composition is applied to mold surfaces to facilitate the release of a molded article formed by curing a molding media on the mold surface. By virtue of the low vapor pressure of the hydrocarbon fluid, the mold release composition is nonhazardous, nonflammable and environmentally friendly, including moderate to high biodegradability.

37 Claims, No Drawings

MOLD RELEASE COMPOSITION

Pursuant to 37 C.F.R. §1.78(a)(4), this application claims the benefit of and priority to prior filed Provisional Application Ser. No. 60/268,376, filed Feb. 12, 2001, which is expressly incorporated herein by reference.

FIELD OF THE INVENTION

This invention relates to a mold release composition for the molding of hydraulic bonding materials, for example, concrete.

BACKGROUND OF THE INVENTION

Concrete release agents are applied to the molds, forms or other surfaces that come in contact with freshly mixed concrete. The majority of concrete release agents contain hydrocarbon solvents, and/or oils that are known to cause health and fire hazard related problems. For example, compositions currently used are known to cause dermatological problems when contacting the skin of certain people. These compositions also threaten groundwater supplies due to spillage, runoff and overspray. Because spraying is a common method of applying concrete release agents, prolonged breathing of their aerosolized mists can cause respiratory problems. Many of these compositions also have a disagreeable odor. Additionally, these materials are known to create contamination when scrap concrete parts containing transferred mold release material are put in landfills. Attempts to overcome one or more of these disadvantages have included using vegetable oil-based and water-based mold release compositions, but the result has been a lowering of the releasability and effectiveness of the mold release composition.

There is thus a need for an effective mold release composition that is environmentally friendly and less hazardous to persons working with the composition.

SUMMARY OF THE INVENTION

The present invention provides a mold release composition for facilitating demolding of hydraulic bonding materials, such as concrete, from molds or other tool surfaces by application of an effective amount of the mold release composition to the mold surfaces. To this end, a mold release composition is provided comprising at least one low vapor pressure hydrocarbon fluid or a blend of low vapor pressure hydrocarbon fluids. In an exemplary embodiment of the present invention, this hydrocarbon fluid is used in combination with a release modifying material. The hydrocarbon fluids in the compositions of the present invention are low vapor pressure fluids having a vapor pressure less than about 0.1 mm Hg at 20° C., making the compositions nonhazardous, nonflammable and environmentally friendly, including at least moderate biodegradability. The low vapor pressure hydrocarbon fluid alone exhibits release characteristics for the bonding materials. However, release ease may be improved or augmented by combining the hydrocarbon with a release modifying material, such as an acid bearing material. In the method for using the composition of the present invention, the composition is applied to the molding tool surface prior to molding the article, then following molding and curing of the article, the article is released from the tool surface.

DETAILED DESCRIPTION OF THE INVENTION

The present invention provides biodegradable release compositions for facilitating the demolding of hydraulic bonding materials, such as concrete, from molds or other surfaces by application of an effective amount of the release composition to the surface, wherein the release composition includes at least one low vapor pressure hydrocarbon fluid. The low vapor pressure hydrocarbon fluid provides superior release and environmental benefits. The hydrocarbon fluid may be combined with a release modifying material, including but not limited to acid bearing materials, such as fatty acids. The raw materials utilized in the composition of the present invention have multiple FDA and EPA approval ratings, even some with direct food contact applications. The mold release composition has a high flash point rating, for example above about 195° F. (90.5° C.), and a low vapor pressure, generally below about 0.1 mm Hg at 20° C., making the composition safer to use not only from the standpoint of fire hazard, but also from the standpoint of worker safety because workers will not have to breathe volatile and often harmful volatilized hydrocarbon fractions. Scrap parts containing transferred release composition of the present invention may be landfilled under stringent regulations due to the moderate to high biodegradability of the raw materials utilized in the composition. The mold release compositions of the present invention are less hazardous to the skin, eye, nose and throat of individuals coming in contact either on a spot or continuing basis.

The mold release compositions of the present invention may also be applied at lower weights to the molds or other substrates, therefore representing not only a cost savings for the customer, but also less release weight percent on the molded concrete article. By way of example, current mold release compositions normally require about 50–90 grams per square meter of tool surface, whereas compositions of the present invention are effective with less than about 50 grams per square meter or less, for example about 20–50 grams per square meter. In addition, the mold release composition exhibits markedly improved "release ease" versus products currently in use in production settings. The molded products release very easily from the tool surface, with little to no-mold buildup. Scrap rates due to part breakage are also significantly reduced.

The main ingredient in mold release compositions of the present invention is a low vapor pressure hydrocarbon fluid, wherein low vapor pressure is understood to refer to a vapor pressure on the order of less than 0.1 mm Hg at 20° C. This low vapor pressure hydrocarbon fluid is biodegradable, resulting in improved degradation characteristics of the product in landfill applications, i.e. when scrap molded articles are discarded. Use of the low vapor pressure hydrocarbon fluids lessens hazards normally associated with conventional mold release systems, such as high volatility, which exposes the worker to inhalation hazards. Moreover, the hydrocarbon fluid of the present invention is typically non-flammable, thereby lessening the hazards associated with conventional flammable mold release systems.

In one example of the present invention, the low vapor pressure hydrocarbon fluid comprises an isoparaffinic hydrocarbon fluid or is a blend of isoparaffinic hydrocarbon fluids, such as a predominantly C12–C20 isoparaffinic hydrocarbon fluid, which refers to a fluid having as a majority component an isoparaffinic hydrocarbon with 12–20 carbons. Examples of such materials include hydrotreated middle petroleum distillates available from Exxon Mobil Corp. under the names Isopar® V and Isopar® M. Isopar® V is classified with CAS No. 64742-46-7, which covers the process for manufacturing hydrotreated middle petroleum distillates. Isopar® V is essentially a branched alkane of relatively low vapor pressure consisting predominantly of C12–C20 isoparaffinic hydrocarbons. It has a minimum flash point of about 244° F. (118° C.), and typically about 262° F. (127.7° C.). The "minimum flash point" corresponds to the flash point when all the molecular fractions of the hydrocarbon fluid are at the low end, whereas the "typical flash point" is the flash point most commonly exhibited by the fluid. Isopar® M is essentially a lower boiling version (i.e. lower molecular weight) of the Isopar® V, and it has a minimum flash point of about 177° F. (80.5° C.), and typically about 199° F. (93° C.). Both of these hydrocarbon fluids further comprise some cycloparaffins and less than 0.1% aromatics. Lower boiling distillates, such as Exxsol® D110, Exxsol® D95, Exxate® 1000, Exxate® 1200 and Exxate® 1300, each from Exxon Mobil Corp., may also be used, alone or in combination, for the low vapor pressure hydrocarbon fluid of the present invention. The Exxsol® fluids are mixed hydrocarbons, specifically, a mixture of normal, cyclo and isoparaffins, and have minimum flash points of about 221° F. (105° C.) and 200° F. (93° C.), respectively, and .typically about 244° F. (117.7° C.) and 205° F. (96.1° C.), respectively. The Exxate® fluids are mono-esters, specifically, a mixture of iso-alkyl acetates, and have typical flash points of 212° F. (100° C.), 225° F. (107° C.) and 264° F. (129° C.), respectively hydrocarbon fluid may also comprise a heavy aromatic fluid, such as Aromatic 200 from Exxon Mobil Corp., which has a typical flash point of 219° F. (104° C.). Polymeric highly branched hydrocarbons also have good release properties. In an example of the present invention, the low vapor pressure hydrocarbon fluid has a molecular weight of at least about 166 g/mol. Additional examples of low vapor pressure hydrocarbon fluids include: linear alpha-olefins, such as Gulftene® 16 and Gulftene® 10 from Chevron Phillips Chemical Co.; branched alpha-olefins, such as Vybar® 825 from Baker Petrolite Corp.; poly alpha-olefins, such as Durasyn® 174 and Durasyn® 166 from Albemarle Corp.; and co-isobutylene-butene polymers, such as Indopol® H100 and Indopol® H300 from BP Chemical Co. Esters of acid bearing materials may also be used. For example, the hydrocarbon fluid may comprise a fatty acid methyl ester, such as methyl caprylate-caprate, methyl laurate 96, methyl laurate 70, methyl myristate 95, methyl palmitate 95, methyl stearate 95, methyl oleate, methyl coconate and methyl palm kemalate. These methyl esters may be obtained, for example, from Cognis under their Emery® brand.

In general, it has been found that higher molecular weight hydrocarbons are most effective in compositions of the present invention, but lower molecular weights may also be used. Additionally, mixtures of high and low molecular weight low vapor pressure hydrocarbons may be used. However, it is desirable to keep the minimum flash point rating above 141° F. (60.5° C.), for example above about 175OF (79.5° C.) and advantageously above about 200° F. (93° C.) for safety purposes. Below 141° F., the materials are flammable. In any event, low vapor pressure hydrocarbon fluids, i.e., with a vapor pressure below about 0.1 mm Hg at 20° C., provide one or more benefits over conventional hydrocarbon carriers. These low vapor pressure hydrocarbon fluids may be used alone, in combination with each other, or may be blended with naturally occurring oils that are biodegradable. By way of further example, the hydrocarbon fluid may comprise a blend of isoparaffinic and heavy aromatic hydrocarbon fluids, or a blend of isoparaffinic, normal paraffinic, cycloparaffinic and heavy aromatic hydrocarbon fluids.

The compositions of the present invention containing the low vapor pressure hydrocarbon fluid exhibit release characteristics by virtue of the low vapor pressure hydrocarbon by itself. However, this low vapor pressure hydrocarbon fluid may advantageously be combined with a release modifying material. These release modifying materials include, but are not limited to, acid bearing materials compatible with the low vapor pressure hydrocarbon fluid, i.e., the release modifying materials form a homogenous mixture or are uniformly dispersed with the hydrocarbon fluid. In an example of the present invention, the release modifying material is a fatty acid, such as oleic acid, linoleic acid, stearic acid, lauric acid, or a mixture of fatty acids. Other acid bearing release modifying materials include natural mixtures of acids such as tall oil, rosin, rosin oil, etc. Silicon polymers and waxes are also suitable release modifying materials that are compatible with the low vapor pressure hydrocarbon fluids. By way of example of the release modifying material, use of a fatty acid forms a reaction product (chelate) of the acid moiety on the fatty acid with calcium that is contained in the portland cement portion of the concrete. It should be understood to those skilled in the art that other fatty acids or acid functional materials than those listed herein may also be acceptable for use as the release modifying material in the composition of the present invention.

In an example of the present invention in which the composition includes a combination of a low vapor pressure hydrocarbon fluid and a release modifying material, the composition includes 99–1% isoparaffinic hydrocarbon fluid in combination with 1–99% of a release modifying material. For example, a mold release composition of the present invention may include about 99–90% by weight of the hydrocarbon fluid or fluids and 1–10% by weight of the release modifying material. By way of further example, a composition of the present invention may include about 97.5% by weight Isopar® V and about 2.5% by weight oleic acid.

The mold release compositions of the present invention may further include optional additives. For example, the compositions may include antioxidants, particularly when being applied to steel molds. The compositions of the present invention may further include a thixotrope to allow for non-sagging/movement of the mold release composition after application to the tool surface. The compositions may further include pigments, such as dyes and solid pigmenting materials. The compositions may further include slip agents, such as waxes, polyalkyl siloxanes, polyaryl siloxanes, and co-polymers of both the reactive and nonreactive type, silicon glycols, etc. The compositions may also include fillers, such as calcium carbonate, barytes, talcs, etc. The compositions may further include fragrances, anti-foams, anti-mists, and corrosion inhibitors.

The compositions of the present invention are primarily useful as release agents for the molding of concrete articles, but the invention is not so limited. The compositions may be used with other hydraulic bonding materials or molding media. Other examples of hydraulic bonding materials include but are not limited to alabaster, plaster, and gypsum. The compositions of the present invention may be applied to a mold or other surfaces via curtain coating, spray application, dipping, brushing, wiping, or any other now known or hereafter developed technique, prior to introduction of the molding media composition. The compositions of the present invention prevent chemical, physical and mechanical bonding of the molding media to the tool surface, i.e. the mold, form or any other containing geometry, before and during the cure cycle of the molding media. The compositions of the present invention provide markedly improved release ease compared to conventional, relatively hazardous release systems currently in use. Release properties exist even when the composition of the present invention is applied at significantly lowered film weights to the tool surface than the film weight necessary with conventional systems. Thus, use of the compositions of the present invention may result in a decrease in volume usage, as well as a decrease in the amount of material transfer to scrap moldings, consequently decreasing the volume of release compositions in landfills. Compositions of the present invention that are transferred to scrap moldings are biodegradable, thus providing a benefit to the environment via both decreased air and water pollution.

EXAMPLE

Molding of roof tiles was conducted using the mold release composition of the present invention. Particularly, the composition included 97.5% Isopar® V and 2.5% oleic acid. The composition was sprayed onto an aluminum tool surface and the molding media added. The molding media included 1 part portland cement, 3 parts sand and 0.4 parts water. The cement was cured for 6–7 hours at a temperature of 125° F. (51.6° C.). In a first pass, wherein each pass includes approximately 100 molds, 5.8–6.2 gm of mold release composition was applied per mold utilizing airless spray equipment operating at 40 psi hydraulic (fluid) pressure. In a second pass, 2.8–3.6 gm of mold release composition was applied per mold with the equipment operating at a hydraulic pressure of 50–55 psi. Other moldings included 2.8–3.2 gm of mold release composition per mold with a 40 psi hydraulic pressure. The results are as follows:

| Grams per Mold Weighed | Results/Comments |
|---|---|
| 5.8–6.2 gm | Very easy release, molds looked clean |
| 2.8–3.6 gm | Very easy release, molds looked clean |
| 3.2 gm | Very easy release, molds looked clean |
| 2.8 gm | Very easy release, molds looked clean |
| 3.0 gm | Very easy release, molds looked clean |
| 3.1 gm | Good release on all parts, cement mixture problem caused some broken tiles |
| 3.1 gm | Very easy release, molds looked clean |
| 3.0 gm | Very easy release, molds looked clean |
| 3.0 gm | Very easy release, molds looked clean |
| 2.8 gm | Very easy release, molds looked clean |

In conclusion, the roof tiles released easily from the tooling surface, and there was no evidence of mold release composition buildup on the tool surface. Moreover, less material was used on the tool surface, resulting in a 40–50% cost savings with equal or better performance as compared to compositions currently in use. The testing further indicates that use of compositions of the present invention will result in cleaner tools, resulting in reduced tool maintenance.

The present invention further provides a method of using the mold release composition to produce molded articles, such as concrete products. A tool surface is provided having a geometry adapted to produce the desired article shape. An effective amount of the mold release composition of the present invention is applied to the tool surface. For example, less than about 50 gm per square meter is sprayed onto the surface. By way of further example, about 20–45 gm per square meter is applied. Freshly mixed concrete or other molding media is then added to the tool surface, followed by curing to form a molded article. The article is then easily released from the tool surface by virtue of the mold release composition.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, numerous examples of commercially available low vapor pressure hydrocarbon fluids have been described, but other such fluids are or may become available that may be used in the composition of the present invention. The invention in its broader aspects is therefore not limited to the specific details, representative apparatus and method and illustrative examples shown and described. Accordingly, departures may be made from such details without departing from the scope or spirit of Applicant's general inventive concept.

What is claimed is:

1. A mold release composition for application to a mold surface, the composition comprising at least one low vapor pressure hydrocarbon fluid of vapor pressure less than about 0.1 mm Hg at 20° C., the composition adapted to facilitate release of a cured hydraulic bonding material from said mold surface.

2. The composition of claim 1, wherein the hydrocarbon fluid is an isoparaffinic hydrocarbon fluid.

3. The composition of claim 1, wherein the hydrocarbon fluid is a branched alkane comprising as a major component an isoparaffinic hydrocarbon having 12–20 carbons.

4. The composition of claim 1, wherein the hydrocarbon fluid is a blend of isoparaffins, normal paraffins, and cycloparaffins.

5. The composition of claim 1, wherein the hydrocarbon fluid is a heavy aromatic fluid.

6. The composition of claim 1, wherein the hydrocarbon fluid is a blend of an isoparaffinic hydrocarbon and a heavy aromatic hydrocarbon.

7. The composition of claim 1, wherein the hydrocarbon fluid is a blend of isoparaffins, normal paraffins, cycloparaffins and a heavy aromatic hydrocarbon.

8. The composition of claim 1, wherein the hydrocarbon fluid is a blend of iso-alkyl acetates.

9. The composition of claim 1, wherein the hydrocarbon fluid is an alpha-olefin.

10. The composition of claim 9, wherein the hydrocarbon fluid is a linear alpha-olefin.

11. The composition of claim 9, wherein the hydrocarbon fluid is a branched alpha-olefin.

12. The composition of claim 9, wherein the hydrocarbon fluid is a poly alpha-olefin.

13. The composition of claim 1, wherein the hydrocarbon fluid is a co-isobutylene-butene polymer.

14. The composition of claim 1, wherein the hydrocarbon fluid is a fatty acid methyl ester.

15. The composition of claim 14, wherein the fatty acid methyl ester is selected from the group consisting of: methyl caprylate-caprate, methyl laurate 96, methyl laurate 70, methyl myristate 95, methyl palmitate 95, methyl stearate 95, methyl oleate, methyl coconate and methyl palm kemalate.

16. The composition of claim 1 having a minimum flash point greater than 141° F. (60.5° C.).

17. The composition of claim 1 having a minimum flash point of at least about 175° F. (79.5° C.).

18. The composition of claim 1 having a minimum flash point of at least about 200° F. (93° C.).

19. The composition of claim 1, wherein the hydrocarbon fluid has a molecular weight of at least about 166 g/mol.

20. The composition of claim 1, further comprising a release modifying material.

21. The composition of claim 20, wherein the release modifying material is an acid bearing material.

22. The composition of claim 21, wherein the acid bearing material is a fatty acid.

23. The composition of claim 21, wherein the acid bearing material is a natural mixture of at least one acid selected from the group consisting of: tall oil, rosin and rosin oil.

24. A mold release composition for application to a mold surface, the composition comprising:

at least one low vapor pressure isoparaffinic hydrocarbon fluid of vapor pressure less than about 0.1 mm Hg at 20° C.; and an acid bearing release modifying material, wherein the composition is adapted to facilitate release of a cured hydraulic bonding material from said mold surface.

25. The composition of claim 24, further comprising at least one low vapor pressure heavy aromatic hydrocarbon fluid.

26. The composition of claim 25, further comprising at least one low vapor pressure normal paraffinic hydrocarbon fluid and at least one low vapor pressure cycloparaffinic hydrocarbon fluid.

27. The composition of claim 24, further comprising at least one low vapor pressure normal paraffinic hydrocarbon fluid and at least one low vapor pressure cycloparaffinic hydrocarbon fluid.

28. The composition of claim 24, wherein the release modifying material is a fatty acid.

29. The composition of claim 24, wherein the acid bearing material is a natural mixture of at least one acid selected from the group consisting of: tall oil, rosin and rosin oil.

30. The composition of claim 24 having a flash point of at least about 175° F. (79.5° C.).

31. The composition of claim 24 having a flash point of at least about 200° F. (93° C.).

32. A method of forming a molded article comprising the steps of:

providing a tool surface for forming an article;

applying an effective amount of a mold release composition to the tool surface, the composition comprising at least one low vapor pressure hydrocarbon fluid of vapor pressure less than about 0.1 mm Hg at 20° C.;

adding a molding media to the tool surface and curing the molding media to form the molded article; and releasing the molded article from the tool surface.

33. The method of claim 32, wherein applying the effective amount includes applying less than about 50 grams per square meter to the tool surface.

34. The method of claim 32, wherein applying the effective amount includes applying about 20–45 grams per square meter to the tool surface.

35. The method of claim 32, wherein the composition further comprises an acid bearing release modifying material.

36. A method of forming a molded article comprising the steps of:

providing a tool surface for forming an article;

applying an effective amount of the mold release composition of claim 1 to the tool surface;

adding a molding media to the tool surface and curing the molded media to form the molded article; and releasing the molded article from the tool surface.

37. A method of forming a molded article comprising the steps of:

providing a tool surface for forming an article;

applying an effective amount of the mold release composition of claim 24 to the tool surface;

adding a molding media to the tool surface and curing the molded media to form the molded article; and releasing the molded article from the tool surface.

* * * * *

UNITED STATES PATENT AND TRADEMARK OFFICE

CERTIFICATE OF CORRECTION

PATENT NO. : 6,620,230 B1
DATED : September 16, 2003
INVENTOR(S) : Wiethorn et al.

It is certified that error appears in the above-identified patent and that said Letters Patent is hereby corrected as shown below:

Column 2,
Line 39, “no-mold” should be -- no mold --.

Column 3,
Line 24, “respectively hydrocarbon” should be -- respectively. The hydrocarbon --.
Line 44, “kemalate” should be -- kernalate --.
Line 53, “175OF” should be -- 175°F --.

Column 6,
Line 59, “kemalate” should be -- kernalate --.

Signed and Sealed this

Second Day of December, 2003

JAMES E. ROGAN
*Director of the United States Patent and Trademark Office*